US008042966B2

(12) United States Patent
Lutz et al.

(10) Patent No.: US 8,042,966 B2
(45) Date of Patent: Oct. 25, 2011

(54) HAND-HELD POWER TOOL

(75) Inventors: Manfred Lutz, Filderstadt (DE); Sim Teik Yeoh, Butterworth (MY); Florian Esenwein, Uhingen-Holzhausen (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 12/878,077

(22) Filed: Sep. 9, 2010

(65) Prior Publication Data

US 2010/0328929 A1 Dec. 30, 2010

Related U.S. Application Data

(62) Division of application No. 11/852,487, filed on Sep. 10, 2007, now Pat. No. 7,815,356.

(30) Foreign Application Priority Data

Sep. 25, 2006 (DE) ..... 10 2006 045 157

(51) Int. Cl.
*B25B 23/18* (2006.01)

(52) U.S. Cl. ..... 362/119; 362/120

(58) Field of Classification Search ..... 362/119–120, 362/577–579, 804, 572–573, 109
See application file for complete search history.

(56) References Cited

U.S. PATENT DOCUMENTS 4,078,869 A * 3/1978 Honeycutt ..... 408/16
6,318,874 B1 * 11/2001 Matsunaga ..... 362/119
6,905,221 B2 * 6/2005 Hsu ..... 362/119
7,278,751 B2 * 10/2007 Chang et al. ..... 362/120

* cited by examiner

*Primary Examiner* — Robert May
(74) *Attorney, Agent, or Firm* — Michael J. Striker

(57) ABSTRACT

A hand-held power tool includes a housing with a tool fitting for receiving an insertion tool, and at least one illuminating element for illuminating the working area of the hand-held power tool; wherein the at least one illuminating element is located in the region of the tool fitting.

5 Claims, 5 Drawing Sheets

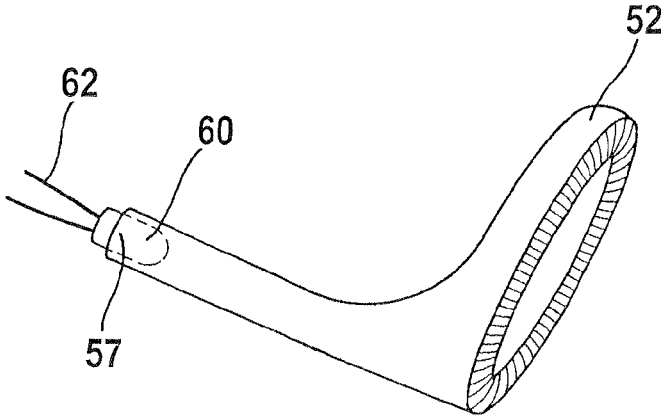
FIG. 6
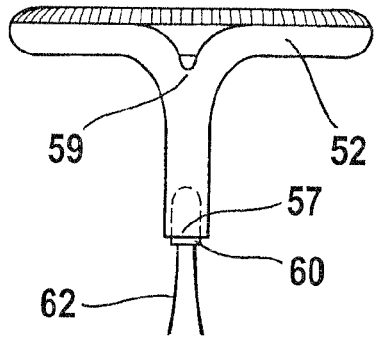
FIG. 7
FIG. 8a
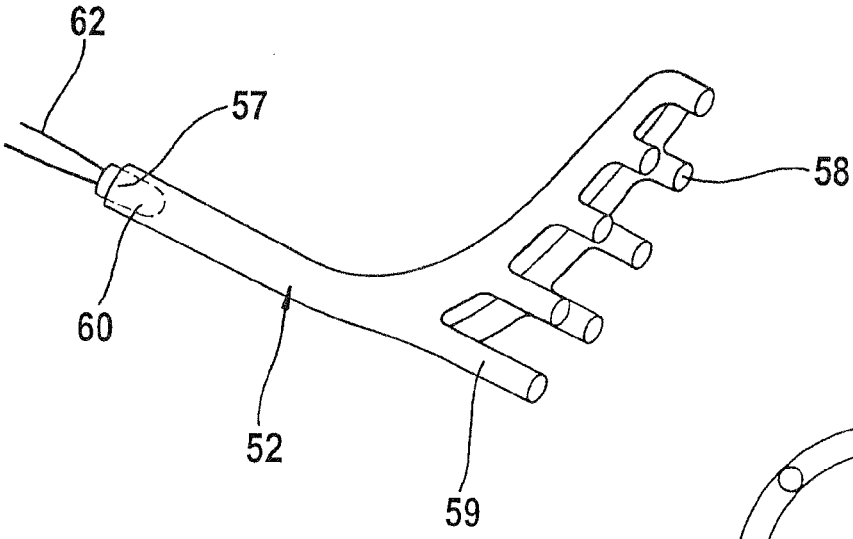
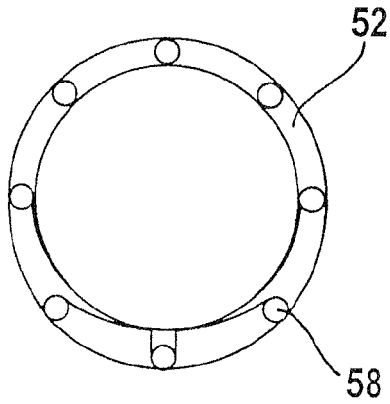
FIG. 8b

HAND-HELD POWER TOOL

CROSS-REFERENCE TO A RELATED APPLICATION

This application is a division of patent application Ser. No. 11/852,487 filed on Sep. 10, 2007 now U.S. Pat. No. 7,815,356, whose subject matter is incorporated here by reference, and provides the basis for a claim of priority of the invention.

The invention described and claimed hereinbelow is also described in German Patent Application DE 102006045157.0 filed on Sep. 25, 2006. This German Patent Application, whose subject matter is incorporated here by reference, provides the basis for a claim of priority of invention under 35 U.S.C. 119(a)-(d).

BACKGROUND OF THE INVENTION

The present invention relates to a hand-held power tool.

Hand-held power tools are made known in the related art that are equipped with a light-emitting diode so that work can be carried out with the hand-held power tool even in poorly-lit surroundings. To this end, the light-emitting diode is located at a suitable point on the hand-held power tool, and it is oriented such that it illuminates the working area. According to DE 102 54 829 A, for example, a hollow cylindrical lamp housing is integrally formed in a lower region of the motor housing, in which a lamp "chute" for accommodating a light-emitting diode is formed. The opening of the lamp housing points in the direction of the working area.

Known hand-held power tools with light-emitting diodes do not adequately illuminate the working area, however, since the light-emitting diode is located relatively far from the working area, due to its location on the hand-held power tool. In addition, with many hand-held power tools, the light-emitting diode illuminates the working area at an angle, e.g., from below or above. As a result, parts of the housing and/or the insertion tool cast a shadow on the working area.

SUMMARY OF THE INVENTION

Accordingly, it is an object of the present invention to provide a hand-held power tool which eliminates the disadvantages of the prior art.

The inventive hand-held power tool provides improved and—in particular—direct illumination of the working area of the hand-held power tool. This is attained by the fact that at least one illuminating element is provided that is located in the region of the tool fitting. As a result, the illuminating element is positioned as close as possible to the working area. The light intensity in the working area is therefore greater than it is with known hand-held power tools. In addition, the illuminating element radiates essentially parallel to the working direction of the hand-held power tool, thereby preventing shadows from being cast.

An illuminating element in terms of the present invention can be an active or passive illuminating element. An active illuminating element is understood to be a luminescent illuminating element in the form of a thermal radiator or a luminescence radiator, i.e., lamps, such as incandescent lamps, halogen lamps, or light-emitting diodes. A passive illuminating element is understood to be a non-luminescent illuminating element, which transports, redirects, and/or radiates light from a light source, e.g., optical waveguides, mirrors, or prisms.

To ensure particularly even illumination of the working area, the at least one illuminating element is preferably located on the periphery—particularly around the circumference—of the tool fitting. It can be, e.g., an annular illuminating element that is located around the tool fitting. An annular illuminating element in terms of the present invention can be formed by an illuminated ring around the tool fitting, which can be subdivided into two or more sub-rings, or it can be formed by several individual points of light located in an annular pattern around the tool fitting. Similarly, instead of an annular illuminating element, a polygonal, e.g., hexagonal or octogonal, illuminating element can be used.

The inventive hand-held power tool includes a housing with a tool fitting for accommodating an insertion tool, e.g., a screwdriver bit or a drill bit. The housing can be designed as one piece or as a multiple-component part. For example, the housing can be composed of a motor housing and a transmission housing. The housing, or only a portion of the housing, e.g., the motor housing, can be composed of two shells that are joinable in a longitudinal axis of the hand-held power tool. As an alternative, the housing can be designed in the shape of a pot or cup. The components of the hand-held power tool are inserted through the open side into the pot-shaped housing before the open side is closed by a further housing part.

The housing or parts of the housing can be composed of plastic or metal. The tool fitting is mounted on the end face of the housing that points in the direction of the working area. At least a portion of the tool fitting can be accommodated in the housing. The tool fitting can also be mounted on the top or side of the housing, e.g., via insertion, clamping, screwing, or being snapped into place. The tool fitting can be any type of clamping tool used to connect the insertion tool with the hand-held power tool in a non-positive manner, e.g., collet chucks, jaw chucks, tapered joints, or system connections (SDS).

According to the present invention, the at least one illuminating element is located in the region of the tool fitting, i.e., all regions around the tool fitting that abut or are adjacent to the tool fitting. This can also be, e.g., directly in front of or behind the tool fitting, relative to the working direction. In particular, is however, the illuminating element is located around the circumference of the tool fitting.

The at least one illuminating element can be accommodated in the housing of the hand-held power tool, in the tool fitting itself, or in a separate housing part for accommodating the illuminating element (referred to below as the lamp housing). The illuminating element can be accommodated, e.g., on the end face of the hand-held power tool, in the housing. It can also be located in a separate lamp housing that is mounted on the end face in front—relative to the working direction—of the housing, or it can be mounted on the housing. The lamp housing can also be integrally formed on the housing, particularly on the end face, of the hand-held power tool. According to the present invention, the illuminating element is located in the region of the tool fitting, particularly around the circumference of the tool fitting, or behind—relative to the working direction—the tool fitting, around the circumference of the output spindle.

In a further embodiment, the illuminating element can be accommodated in a separate lamp housing that is detachably connected with the housing of the hand-held power tool. This means the separate lamp housing with the illuminating element can be installed and removed. The detachable connection can be realized, e.g., via a screw joint, clamping, a snap-in mechanism, or insertion. The lamp housing with the illuminating element can is therefore be installed on the housing as needed, e.g., when the surroundings are poorly lit. In a preferred embodiment of a detachable lamp housing, one or more illuminating elements are located in an annular lamp housing that can be installed on the end face of the housing of the hand-held power tool around the tool fitting, e.g., using snap-in elements. The power supply can be realized, e.g., using plug contacts.

In a preferred embodiment, the at least one illuminating element is a light-emitting diode. It is possible to attain even greater illumination of the working area by using several, e.g., two or three, illuminating elements, particularly light-emitting diodes. Several illuminating elements can be installed at various points in the region of the tool fitting. If several illuminating elements, particularly light-emitting diodes, are provided, they can be distributed evenly or unevenly around the circumference of the tool fitting. In particular, they are located in a plane that is transverse to the longitudinal axis of the hand-held power tool. For example, two light-emitting diodes can be positioned diametrically relative to each other, or three light-emitting diodes can be located in an equilateral triangle relative to each other. An even larger number of illuminating elements can be positioned, e.g., equidistantly around the circumference.

For power supply, each of the illuminating elements can be connected separately with two power supply lines. As an alternative, several illuminating elements can be connected in series. This reduces the number of power supply lines required.

If the illuminating elements are light-emitting diodes, it is particularly advantageous to locate the light-emitting diodes on a printed circuit board with traces, because then it is only necessary to ensure that power is supplied to the printed circuit board. Voltage is supplied to the illuminating elements via the traces of the printed circuit board. The printed circuit board is preferably annular in shape, thereby enabling it to be positioned around the tool fitting or the output spindle. The illuminating elements can be positioned anywhere on an annular printed circuit board, e.g., at regular or irregular intervals.

If light-emitting diodes are used as the illuminating elements, the light-emitting diodes can include wire terminations, which are guided through clear via holes in the printed circuit board and are soldered on the back side of the printed circuit board (or via buried layers) (through-contacting). Preferably, however, the light-emitting diodes are soldered directly on the printed circuit board using solderable terminal pads and without wire terminations, as a surface mounted device (SMD), thereby reducing the amount of installation space required for the illuminating elements. For power supply, the printed circuit board can be provided with a flexible cable, which can also be soldered onto the printed circuit board.

In a further preferred embodiment, the illuminating element is an optical waveguide. The optical waveguide is preferably bent in an annular shape in the region of the tool fitting. The advantage of using an optical waveguide as the illuminating element is that one or more light sources can basically be located at any point in or on the housing of the hand-held power tool. The light source can be accommodated in the housing, e.g., in the region of the handle, or at any other suitable point that has space for a light source. The distance between the light source and the region of the tool fitting is insignificant.

Another insignificant point is the obstacles—in the form of components (electric motor, transmission, etc.) for propagating light—that are located in the housing between the light source and the region of the tool fitting, because the optical waveguide can be guided around the obstacles. A light-emitting diode, for example, can be used as the light source. The light source is located at an opening of the optical waveguide in order to feed the light from the light source into the optical waveguide. The light is guided by the optical waveguide and can thereby reach the region of the tool fitting, where the light can exit in the direction of the working area.

The optical waveguide can be rigid or flexible in design. A flexible optical waveguide is preferably located in the housing, while a rigid optical waveguide can be located in the housing, or it can be designed as part of the housing.

The optical waveguide can be designed as one piece or a multiple-component part. With a multiple-component optical waveguide, the parts are connected with each other, e.g., in a bonded manner via gluing, or in a form-fit manner using socket elements, dovetail-like connecting elements, or the like. The connection area is designed such that the light from a first optical waveguide part can be directed into a second optical waveguide part connected with the first optical waveguide part. A multiple-component optical waveguide has the advantage that it can be used to realize complex optical paths, e.g., when the optical waveguide in the housing must be guided around other components in the housing. Using a multiple-component optical waveguide, it is also possible to divide the light emitted by a light source into several sub-beams, so that the light can be transported to and exit from several points.

An optical waveguide can be detachably or non-detachably connected in or on the housing. It can be bonded in the housing, for example, or deformed via hot embossing and connected with the housing. It can also be connected in a form-fit manner, e.g., via clamping or snapping into place. If the optical waveguide is detachably connected with the housing, this has the advantage that it can be replaced. The optical waveguide can be designed, e.g., as two pieces, with a first optical waveguide element having an opening into which the light from a light source is fed This first optical waveguide element is integrated, e.g., fixedly in the housing of the hand-held power tool. It includes a connecting element that can be detachably connected with a connecting element, e.g., a socket element of a second optical waveguide element, it being possible for the second optical waveguide element to be detachably connected in or on the housing in the region of the tool fitting. For example, an, e.g., annular recess can be provided on the end face of the hand-held power tool, into which the second optical waveguide element can be inserted from the outside.

In a preferred embodiment of the inventive hand-held power tool, at least one lens is moved in front—relative to the direction of radiation—of the at least one illuminating element. The lens can be a convex or concave lens. Particularly preferably, two lenses are moved in front—relative to the direction of radiation—of the illuminating element. The first lens—as viewed in the direction of radiation—is a convex lens in particular, which bundles the light from the illuminating element and forms an essentially parallel light beam. The second lens—as viewed in the direction of radiation—is also a convex lens in particular, which forms a divergent light beam, in order to illuminate the working area as evenly as possible. The light intensity and size of the illuminated area in the working area can be influenced via the selection of the lenses and their positioning in the direction of radiation relative to the illuminating element. Within the framework of the present invention, the lens is considered to be every component—particularly those composed of plastic—in which a lenticular region is formed, which, due to its convex or concave shape and its position relative to the illuminating element, is suitable for acting as an optical lens.

The at least one lens is preferably located on an annular carrier, which is located in front—relative to the working direction—of the illuminating element, around the tool fitting or the output spindle. The lens and carrier are preferably composed of plastic. As an alternative, the carrier itself can be designed as a lens by curving the surface of the carrier convexly or concavely.

In a preferred embodiment, the light beam radiated by the at least one illuminating element is designed to be adjustable, so that the focus or scattering of the light beam can be increased. This can be realized, e.g., by making the distance—in the direction of radiation—between the at least one illuminating element and the at least one lens, i.e., the longitudinal distance, adjustable. The longitudinal distance can be adjustable, e.g., via longitudinal displacement or by rotating the illuminating element and/or the lens relative to each other, e.g., along a longitudinal guide or a thread provided therefor. As an alternative, the light beam can also be adjustable by placing several lenses with different focal distances next to each other on an annular carrier. By rotating the carrier and/or the illuminating element in the circumferential direction of the hand-held power tool, a lens with a suitable focal distance for the application can be moved in front of the illuminating element.

The inventive hand-held power tool includes an on/off switch, which is located in the region of the handle in particular, in order to turn the electric motor on and off. With the inventive hand-held power tool, the on/off switch can be configured such that it also serves as an on/off switch for the at least one illuminating element. When the operator actuates the on/off switch, the electric motor for driving the hand-held power tool and the at least one illuminating element are switched on.

The on/off switch can also be provided with at least two stages, so that, in a first stage, the at least one illuminating element is activatable, and an electric motor is also activatable in a second stage. In this embodiment, the illuminating element can be advantageously switched on without simultaneously activating the electric motor. For example, the hand-held power tool can also be used as a flashlight, in order to illuminate the work site before working with the hand-held power tool, e.g., before performing a drilling or screwing operation. A two-staged switch can be designed, e.g., such that the first stage is reached by pressing gently on the switch, and, to reach the second stage, the switch is pressed with greater force, or it must be pressed through. If several, e.g., two or three, illuminating elements are provided, then it is also possible to install a multiple-staged—particularly more than two-staged—on/off switch on the hand-held power tool, so that a first illuminating element is activatable in a first stage, a second illuminating element is activatable in a second stage, and a third illuminating element is activatable in a third stage, etc. In the final stage, it is also possible to activate an electric motor. A two- or multiple-staged switch can also be designed as a rotary knob or a toggle switch.

In another embodiment, a separate on/off switch can be provided for the at least one illuminating element, which is activatable independently of the on/off switch for the electric motor. This has the advantage, e.g., that the hand-held power tool can be operated without simultaneously switching on the illuminating element. In well-lit surroundings, it is therefore possible, e.g., to avoid the additional energy consumption by the illuminating element. This is desirable, in particular, for hand-held power tools operated with rechargeable batteries. As described above, a separate on/off switch can also be designed with multiple stages, so that an illuminating element can be activated in each stage, when several illuminating elements are involved. The light intensity can therefore be adapted to the lighting conditions of the surroundings.

The light intensity of the at least one illuminating element can also be designed to be adjustable by providing a dimmer. Dimmers for steplessly adjusting the light intensity are basically known and are common to one skilled in is the art. A dimmer can be installed on the inventive hand-held power tool as an additional switch, e.g., in the form of a rotary knob.

In a refinement of the present invention, the illuminating element can also be used as signal lights by the controller with electronic components. For example, several light-emitting diodes can be located on an annular printed circuit board, which are activated in chronological sequence in the manner of a chaser. When all light-emitting diodes are illuminated simultaneously, this is a signal to the user, e.g., that the hand-held power tool is overloaded. The illuminating element can also be designed as a blinking light, which indicates, e.g., the state of charge of the rechargeable battery pack. If several illuminating elements are provided, these lights can emit different colors. For instance, light-emitting diodes in green, yellow and red can indicate different states of charge of the rechargeable battery pack.

The inventive hand-held power tool can be mains-operated or it can use a rechargeable battery pack, and it can be, e.g., a drill, a rotary hammer, a screwdriver, or an impact wrench.

The novel features which are considered as characteristic for the present invention are set forth in particular in the appended claims. The invention itself, however, both as to its construction and its method of operation, is together with additional objects and advantages thereof, will be best understood from the following description of specific embodiments when read in connection with the accompanying drawings.

BRIEF DESCRIPTION OF THE DRAWINGS

FIG. 6 shows a first embodiment of an optical waveguide in accordance with the present invention.

FIG. 7 shows a second embodiment of an optical waveguide in accordance with the present invention.

FIG. 8 shows a third embodiment of an optical waveguide in accordance with the present invention.

DESCRIPTION OF THE PREFERRED EMBODIMENTS

Figure 1:
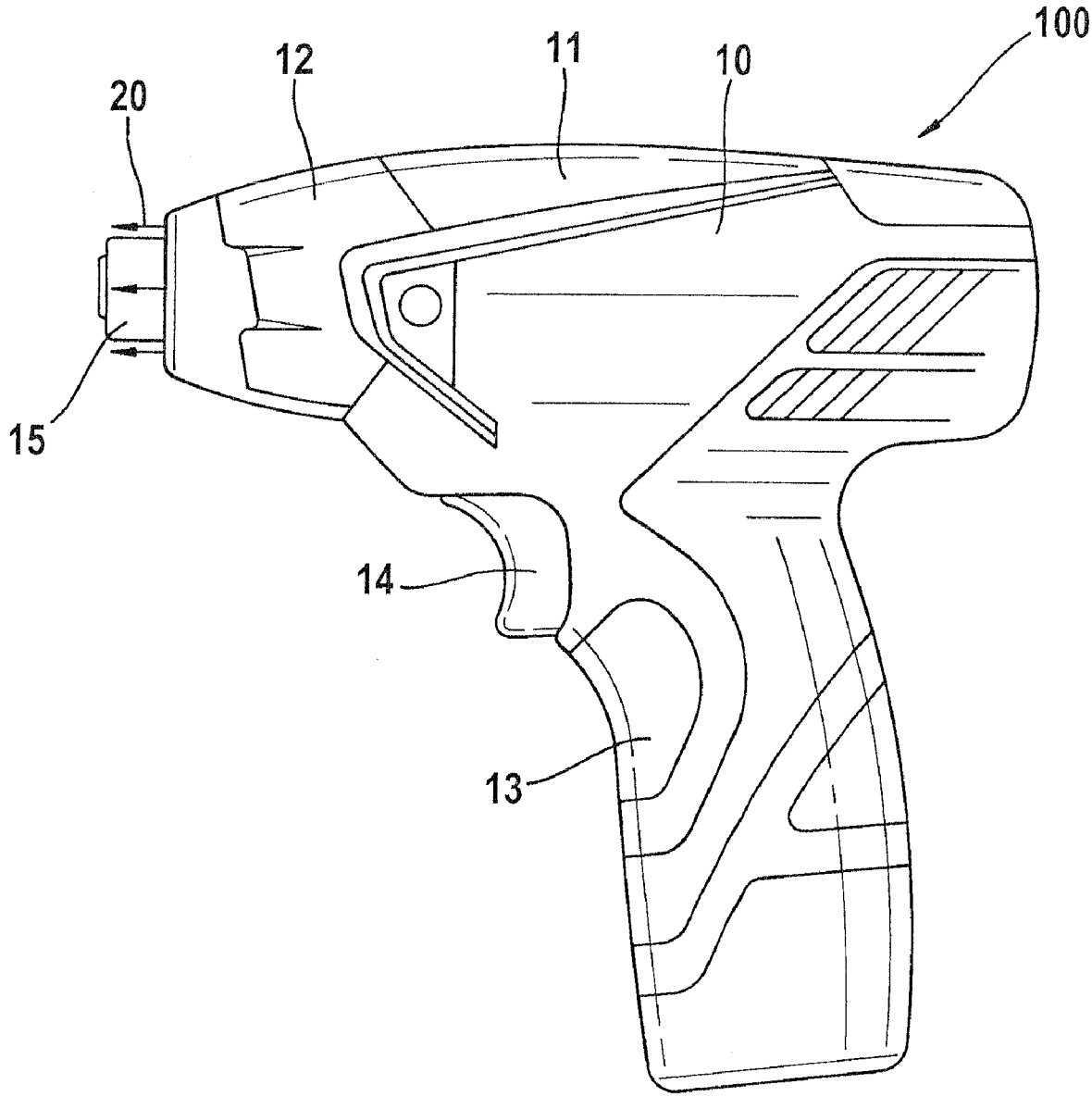
FIG. 1 shows a first exemplary embodiment of an inventive hand-held power tool, in a side view.

A rotary-impact wrench 100 is shown in FIG. 1, as an embodiment of an inventive hand-held power tool. Housing 10 is composed of two pieces, a motor housing 11 and a transmission housing 12. An on/off switch 14 is provided in the region of handle 13, with which an electric motor 17 (FIG. 4) is activatable. A tool fitting 15 for accommodating insertion tools, screw bits in particular, is located in the front—relative to the working direction—region of housing 10. Furthermore, the direction of radiation of light-emitting diodes is indicated in FIG. 1 via arrows 20. The light-emitting diodes are provided as illuminating elements 22 (FIG. 2) in the region of tool fitting 15. As indicated by arrows 20, illuminating elements 22 are located around the circumference of tool fitting 15.

Figure 2:
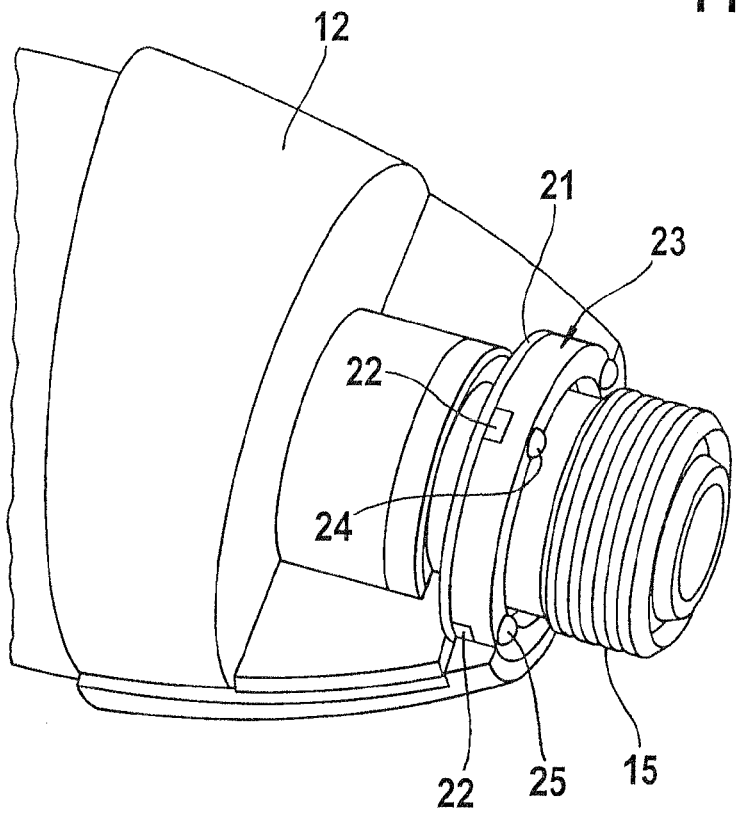
FIG. 2 shows a section of the inventive hand-held power tool in FIG. 1, in the region of the tool fitting, in a perspective view.

FIG. 2 shows a section of the front—relative to the working direction—region of rotary-impact wrench 100 with transmission housing 12 and tool fitting 15. Transmission housing 12 is shown in a partial cross-section, in the perspective view in FIG. 2. An annular printed circuit board 21 is located around tool fitting 15, on the end face of transmission housing 12, on which several light-emitting diodes are installed, as illuminating elements 22. In the embodiment shown, these are light-emitting diodes without wire terminations (SMD light-emitting diodes) that are mounted directly on printed circuit board 21, e.g., via soldering. In front—relative to the working direction—of printed circuit board 21 with illuminating elements 22, an annular carrier 23 with convex lens 25 is located in front—relative to the direction of radiation—of illuminating elements 22.

Carrier 23 is composed of a transparent plastic. Lenses that serve to bundle the light rays are integrally formed in or on carrier 23. Convex lenses 25 are shown in FIG. 2. FIG. 2 also shows that printed circuit board 21 with illuminating elements 22, and carrier 23 with lens 25 are accommodated in to transmission housing, on its end face. As an alternative, the system composed of printed circuit board with illuminating elements, and carrier with lens, can also be accommodated in a separate housing, which is capable of being installed (not shown), e.g., on the end face of the transmission housing or in the front region on the transmission housing.

Figure 3:
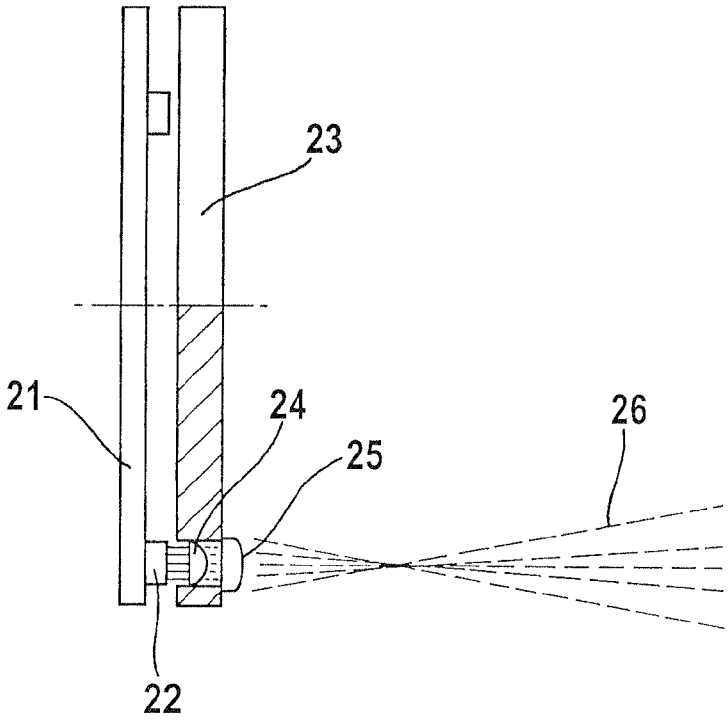
FIG. 3 shows a schematic view of a printed circuit board with illuminating element, and a carrier with lens of the inventive hand-held power tool in FIG. 1.

The system composed of two convex lenses 24 and 25 for bundling light rays from illuminating element 22 is shown in greater detail in FIG. 3. The lower half of FIG. 3 is a cross-sectional view through printed circuit board 21 with illuminating element 22 in the form of an SMD light-emitting diode, and through carrier 23 with a first convex lens 24 and a second convex lens 25 located in front—relative to the direction of radiation—of illuminating element 22. The direction of radiation is indicated in FIG. 3 via dashed lines 26.

Figure 4:
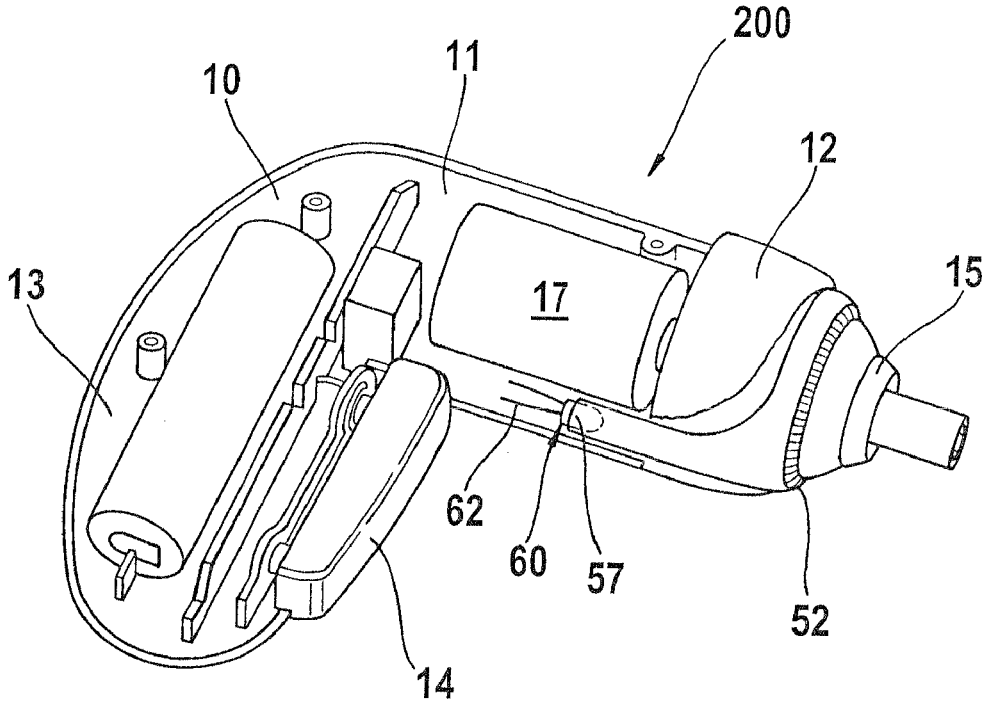
FIG. 4 shows a second embodiment of an inventive hand-held power tool, in a perspective view.

A second embodiment of an inventive hand-held power tool is shown in FIG. 4. Identical or similar components are labelled with the same reference numerals. A cordless screwdriver 200 has a housing 10 with a motor housing 11, a transmission housing 12, and a handle 13. Transmission housing 12 is shown in a exposed view, and the rest of housing 10 is shown open. Electric motor 17 is activatable using an on/off switch 14. A tool fitting 15 is located on the end face of transmission housing 12. An optical waveguide 52 is provided around tool fitting 15, and it is accommodated on the end face of transmission housing 12 in transmission housing 12. An LED is located at an opening 57 of optical waveguide 52, as light source 60, so that the light from the LED is fed into optical waveguide 52. Light source 60 includes wire terminations.

Figure 5:
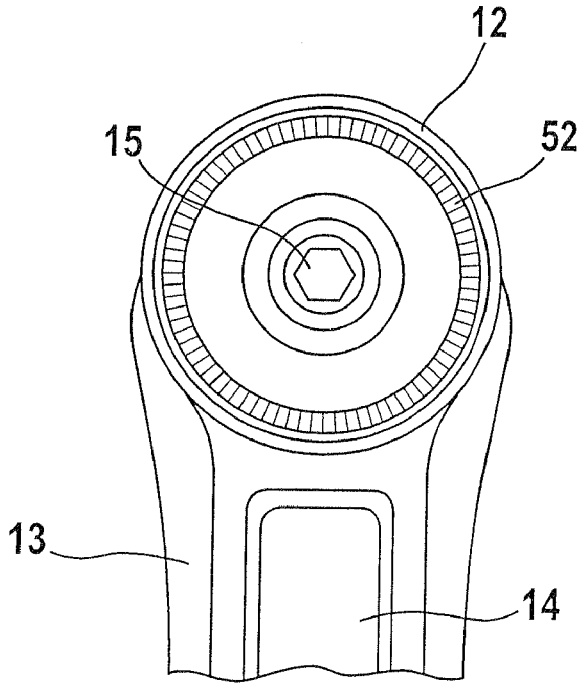
FIG. 5 shows a section of the inventive hand-held power tool in FIG. 4, in a front view in accordance with the present invention.

FIG. 5 shows that optical waveguide 52 is located around tool fitting 15 in an annular shape. Optical waveguide 52 has the advantage over the embodiment with several light-emitting diodes according to FIGS. 1 through 3 that a circumferential ring of light can be created, rather than punctiform illuminating elements. As a result, the working area of the hand-held power tool can be illuminated evenly.

Three embodiments of optical waveguides are shown in FIGS. 6 through 8; they can be inserted in the region of the tool fitting, particularly around the circumference of the tool fitting. FIG. 6 shows an optical waveguide 52 in the form of a closed ring with an opening 57 for feeding the light from a light source 60. As an alternative, FIG. 7 shows an optical waveguide 52 in the form of an open ring. Optical waveguide 52 includes a branching 59, at which optical waveguide 52 separates. The light from light source 60, which is fed at an opening 57 into optical waveguide 52, also separates accordingly at branching 59. FIG. 8 shows an annular optical waveguide 52 with several branchings 59, which project outwardly from optical waveguide 52. Branchings 59 are located at essentially identical intervals around annular optical waveguide 52. Branchings 59 have light apertures 58 on their free ends, through which the light can radiate outwardly essentially as points of light.

Figure 9:
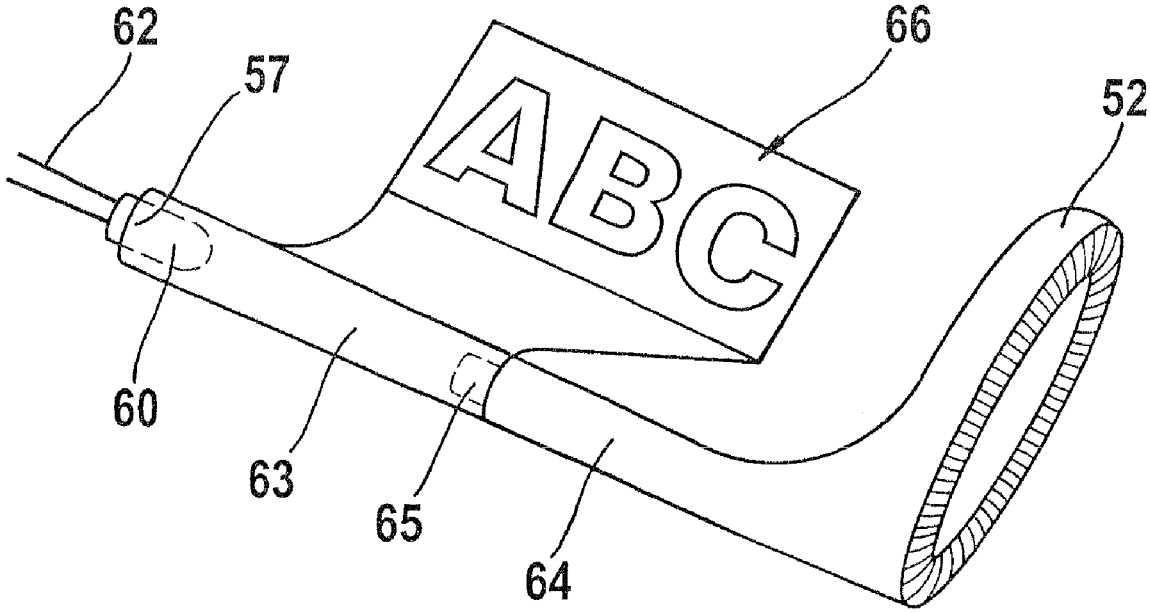
FIG. 9 shows a further embodiment of an optical waveguide in accordance with the present invention.

A further embodiment of an optical waveguide 52 is shown in FIG. 9. Optical waveguide 52 is designed as two pieces. It is composed of a first optical waveguide element 63 and a second optical waveguide element 64, which are interconnected via a socket connection 65 such that the light from light source 60 is transported from first optical waveguide element 63 to second optical waveguide element 64. First optical waveguide element 63 not only transports light to second optical waveguide element 64, it also serves to illuminate a lettering motif 65 (or other design elements).

It will be understood that each of the elements described above, or two or more together, may also find a useful application in other types of constructions differing from the type described above.

While the invention has been illustrated and described as embodied in a hand-held power tool, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

The invention claimed is:

1. A hand-held power tool, comprising:

a housing;

a tool fitting for receiving an insertion tool, wherein said tool fitting has a circumference;

at least one illuminating element configured as a light-emitting diode for illuminating a working area of the hand-held power tool, wherein said at least one illuminating element is located in a region of said tool fitting and around said circumference of said tool fitting;

an annular carrier, and a plurality of lenses located on said annular carrier and arranged such that at least one lens is arranged in front of said at least one illuminating element relative to a direction of radiation of said at least one illuminating element; and an annular printed circuit board, said light-emitting diode being located on said annular printed circuit board;

wherein each of said plurality of lenses have different focal distances and, wherein at least one member selected from the group consisting of said carrier, said illuminating element, and both is rotatable relative to each other member such that a respective one of said lenses having a certain focal distance is movable in front of said at least one illuminating element.

2. A hand-held power tool as defined in claim 1, wherein said at least one illuminating element radiates a light beam and, further comprises means for adjusting the light beam of said at least one illuminating element and including said plurality of lenses.

3. A hand-held power tool as defined in claim 2, wherein said plurality of lenses is configured so that it adjusts the light beam radiated by said at least one illuminating element in a manner selected from the group consisting of focusing the light beam and scattering the light beam.

4. A hand-held power tool as defined in claim 1, further comprising:

an electric motor; and an on/off switch having at least two stages and configured so that in a first one of said at least two stages said at least one illuminating element is activated, while in a second one of said at least two stages said electric motor is activated.

5. A hand-held power tool, comprising:

a housing;

a tool fitting for receiving an insertion tool, wherein said tool fitting has a circumference;

at least one illuminating element configured as a light-emitting diode for illuminating a working area of the hand-held power tool, wherein said at least one illuminating element is located in a region of said tool fitting and around said circumference of said tool fitting;

an annular carrier comprising at least three lenses and arranged such that at least one lens is positioned arranged in front of said at least one illuminating element relative to a direction of radiation of said at least one illuminating element; and an annular printed circuit board, said light-emitting diode being located on said annular printed circuit board;

wherein said at least three lenses provided on said annular carrier have different focal distances, and wherein at least one member selected from the group consisting of said annular carrier, said illuminating element, and both is rotatable relative to the other member such that each of said at least three lenses are movable in front of said illuminating elements.

* * * * *